US007585284B2

(12) United States Patent
Zhadanov et al.

(10) Patent No.: US 7,585,284 B2
(45) **Date of Patent: *Sep. 8, 2009**

(54) BODY RUBBING DEVICE

(76) Inventors: Sam Zhadanov, 2944 W. 5th St., Apt 20 J, Brooklyn, NY (US) 11224; Eli Zhadanov, 2944 W. 5th St., Apt 20 J, Brooklyn, NY (US) 11224

( * ) Notice: Subject to any disclaimer, the term of this patent is extended or adjusted under 35 U.S.C. 154(b) by 60 days.

This patent is subject to a terminal disclaimer.

(21) Appl. No.: 10/838,068

(22) Filed: May 4, 2004

(65) Prior Publication Data

US 2005/0251071 A1 Nov. 10, 2005

(51) Int. Cl.
*A61H 7/00* (2006.01)

(52) U.S. Cl. ..... 601/136; 601/137

(58) Field of Classification Search ..... 601/112–113, 601/116–117, 122, 124, 125, 131, 134–137; 401/282, 286; 15/144.1, 144.3
See application file for complete search history.

(56) References Cited

U.S. PATENT DOCUMENTS

| | | | | |
|---|---|---|---|---|
| 4,741,329 | A * | 5/1988 | Marcune | 600/41 |
| 5,228,387 | A * | 7/1993 | Siculan | 101/211 |
| 6,017,320 | A * | 1/2000 | Bleeker et al. | 601/125 |
| D426,641 | S * | 6/2000 | Smith | D24/211 |
| 6,093,159 | A * | 7/2000 | Racoosin | 601/131 |
| 6,793,434 | B1 * | 9/2004 | Olson | 401/286 |

* cited by examiner

*Primary Examiner*—Michael A. Brown
(74) *Attorney, Agent, or Firm*—I. Zborovsky

(57) ABSTRACT

A body rubbing device has a housing having a lower side adapted to face a body part to be acted upon and an upper side, the housing having an upper surface which is upwardly convex and is elongated in a longitudinal direction to define a substantially oval shape, the upper convex surface being formed so that a palm of a user's hand can rest on the upper convex surface, a handle placeable between fingers of the user's palm and extending substantially over a part of the housing, the housing also having a lower surface at the lower side, and acting means provided on the lower surface of the housing for acting on a body part of a user.

26 Claims, 6 Drawing Sheets

BODY RUBBING DEVICE

BACKGROUND OF THE INVENTION

The present invention relates generally to body rubbing devices.

Body rubbing devices are known in the art. They are usually used for applying an action on a body part of a user. The existing devices, include an action means provided on the housing to act on a body part of the user. It is believed that the existing body rubbing devices can be further improved.

SUMMARY OF THE INVENTION

Accordingly, it is an object of the present invention to provide a body rubbing device which is a further improvement of the existing shampoo brushes.

In keeping with these objects and with others which will become apparent hereinafter, one feature of the present invention resides, briefly stated, in a body rubbing device which has a housing having a lower side adapted to face a body part of a user to be acted upon and an upper side, said housing having an upper surface which is upwardly convex and is elongated in a longitudinal direction to define a substantially oval outer edge having two ends spaced from one another in a longitudinal direction and two ends spaced from one another in a transverse direction, said upper concave surface being formed so that a palm of a user's hand can rest on said upper concave surface; a handle placeable between fingers of the user's palm and extending in the longitudinal direction, said housing further having a lower surface at said lower side; and acting means provided on said lower surface of said housing for acting on a body part of a user.

When the body rubbing device is designed in accordance with the present invention, it constitutes a further improvement of the existing body rubbing devices.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 13, 14, and 15 are a side view, a bottom view and a bottom view on a lower part only of a body rubbing device in accordance with a further embodiment of the present invention, while

DESCRIPTION OF THE PREFERRED EMBODIMENTS

Figure 2:
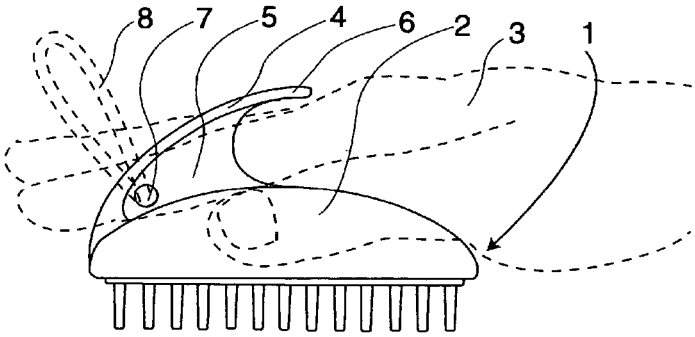
Figure 3:
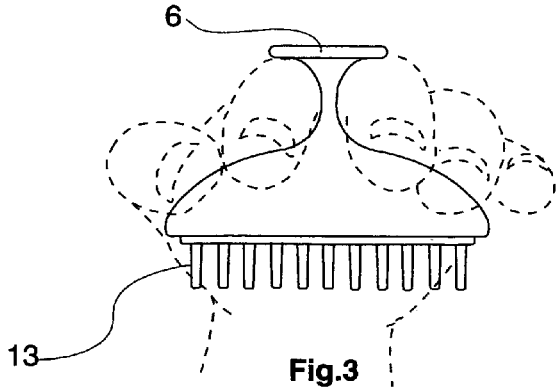

A body rubbing device in accordance with the present invention has a housing which is identified as a whole with reference numeral 1. The housing 1 has an upper part with an upper side and a lower side as seen in FIGS. 2 and 3. The housing 1 has an upper surface which is identified with reference numeral 2 and is formed as an upwardly concave surface as can be seen in FIG. 2, so that a palm of a user 3 can be placed on the upper surface 2 of the body rubbing device as shown in FIGS. 1 and 2.

The body rubbing device further has a handle which is identified with reference numeral 4. The handle extends from one end of the housing, which is a left end in FIG. 2, toward the other opposite end of the housing, in a longitudinal direction and over a part of the length of the housing 1, measured in direction from the one to the other ends in FIG. 2. The handle 4 has a lower narrow part 5 and an upper wide part 6. When the user's palm 3 is placed on the convex surface 2, the narrow part 5 can be located between two fingers of the user's hand, and the upper part 6 is located on top of the fingers.

A throughgoing opening 7 is provided in the housing, so that a rope 8 can extend through the opening 7 to suspend the body rubbing device when not in use. The opening 7 is provided in the handle 4 in its region close to the upper surface 2.

Figure 1:
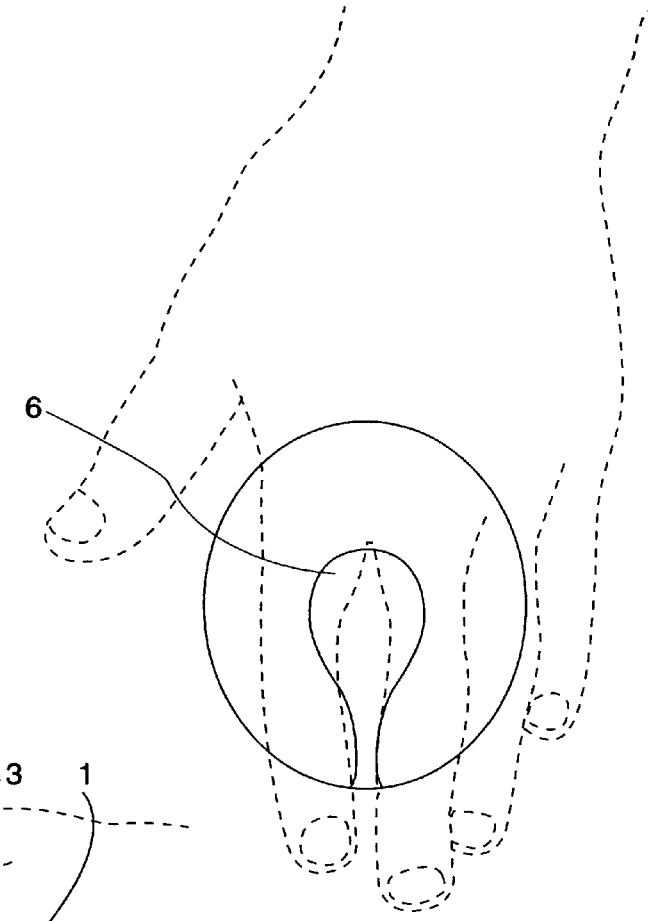
FIGS. 1, 2, and 3 are a plan view, a side view, and a front view of a body rubbing device in accordance with the present invention.

As can be seen from FIG. 1, the housing 1 has a substantially oval shape on a plan view with an oval peripheral edge, having two longitudinal ends which are spaced from one another in a longitudinal direction (a vertical direction in FIG. 1), and two transverse ends which are spaced from one another in a transverse direction (a horizontal direction in FIG. 1).

The housing 1 is composed of an upper portion 9 and a lower portion 10 together forming a hollow interior. The lower portion 10 is removably connectable to the upper portion 9. The connecting means for connecting the portions 9 and 10 with one another can be formed for example by a circular groove 11 provided in the upper portion 9, and at least one, preferably two projections 12 provided in a lower portion 10 and engageable into the groove 11. For this purpose at least the projections 12 can be made elastic so as to snap into the circular groove 11.

The lower part 10 has action means which are identified as a whole with reference numeral 13 and formed to act on a body part of a user, as will be explained in detail herein below. When the upper part 9 and the lower part 10 are assembled with one another, they form a hollow interior 14.

Figure 4:
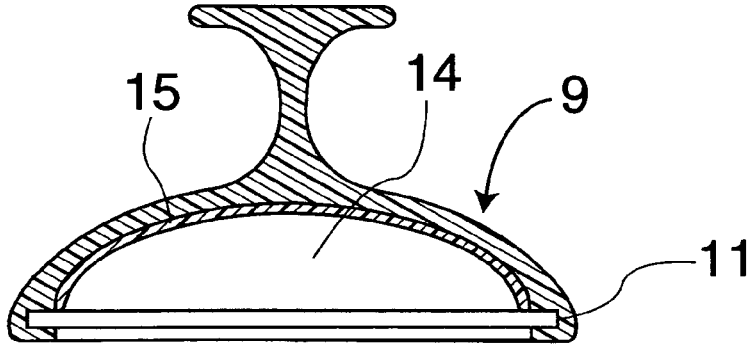
FIG. 4 is a transverse cross-section of an upper part of the housing of the inventive body rubbing device.
Figure 5:
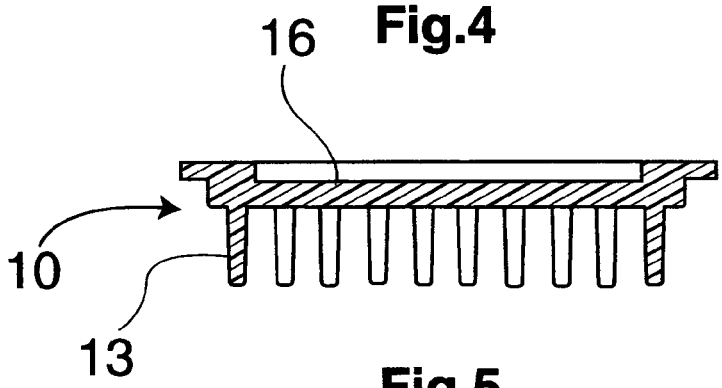
FIGS. 5 and 6 are a transverse cross-section and a view from below of a lower part of the housing of the inventive body rubbing device.

In accordance with the present invention, a plurality of color insert plates are provided. One of such cover insert plates is shown in FIG. 4. It is inserted in the interior 14 of the housing 1 and lies on an inner surface of an upper wall of the part 9. The color plate can be held against the inner surface by elastic properties of the color plate 15, or can be glued by a transparent glue. The above mentioned plurality of the color plates are provided preferably for identifying the device in accordance with its applications for specific purposes, and additionally for increasing attractive look of the device. The color plates can have different colors, which are selected for example to correspond to the body rubbing devices designed for a specific use. In order to visualize the color, at least the upper wall of the upper part 9 is formed transparent, for example from a clear plastic. In accordance with a preferable embodiment, both the upper part 9 and the lower part 10 are composed of clear plastic. Also, the upper part 9 and the lower part 10 can be each formed as one-piece integral element.

The lower part 10 has a lower wall 16, which can be elastic so that when the body rubbing device is used for applying corresponding action to the body part of a user, the lower wall 16 flexibly deflects to provide a fine, delicate action.

Figure 6:
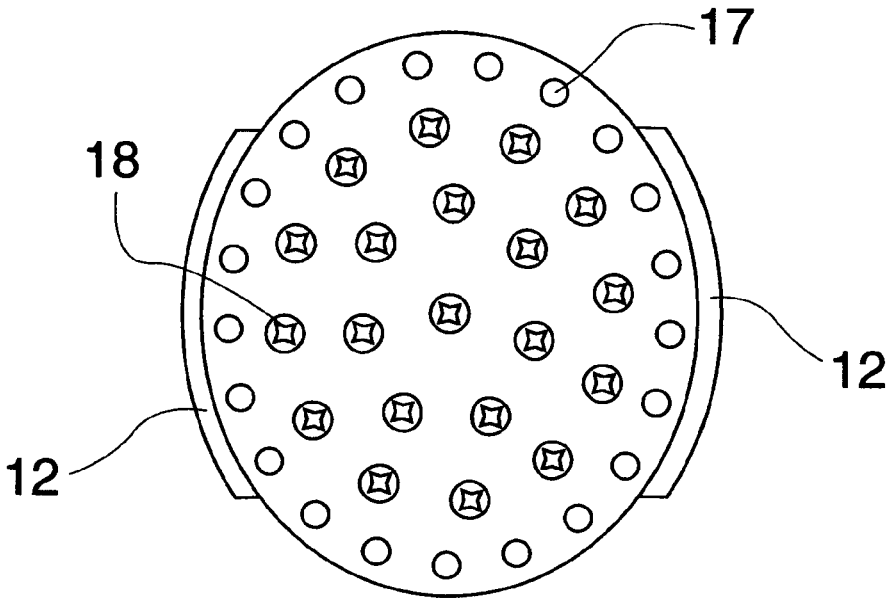
Figure 7:
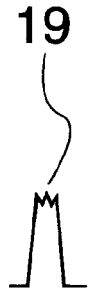
FIG. 7 is a cross-section of one of action elements of the inventive body rubbing device.

The lower part in the embodiment shown in FIGS. 2, 3, 6 is designed as a brush having the wall 16 provided with a plurality of cushion-like elastic spikes for acting on a user's scalp. As shown in FIG. 6, some of the spikes which are identified with reference numeral 17 are arranged on the periphery of the lower surface of the wall 16, while other spikes which are identified with reference numerals 18 are provided in the center of the lower surface of the wall 16, and formed so that the spikes 18 are thicker than the spikes 17. Also, the spikes 18 can be provided with small tooth-like projections 19. The spikes 17 preferably are elastic.

Figure 8:
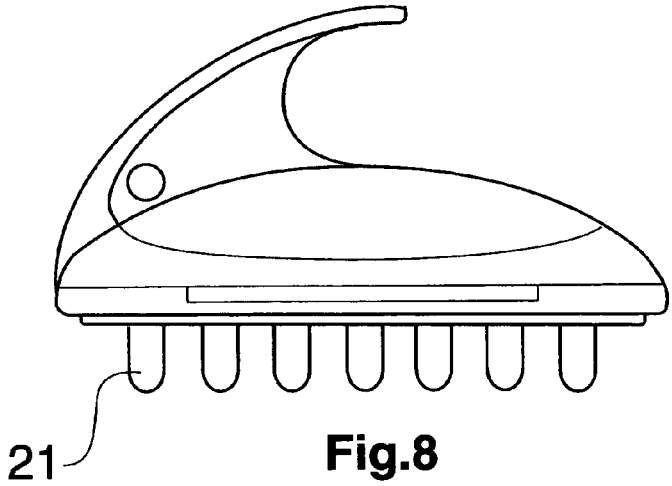
FIGS. 8, 9, 10, 11, and 12, are views showing modifications of the lower part of the body rubbing device in accordance with the present invention.

FIG. 8 illustrates the lower portion in which the action means are designed for body massaging. Here, the action means include a plurality of relatively thick projections 21 which are designed so that when the body rubbing device applies an action to a body part of the user, the projections 21 produce a massaging action.

Figure 9:
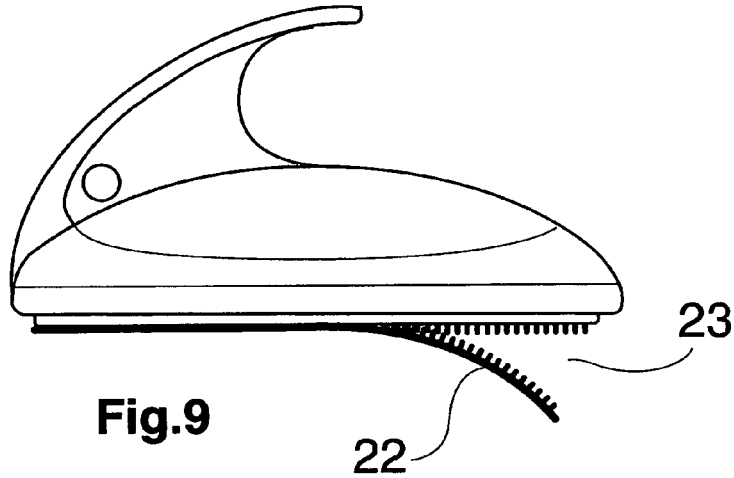

FIG. 9 shows the lower portion of the body rubbing device in which the action means include an abrasive pad attachment with an abrasive layer 22 attached to the lower wall 16 for example by an adhesive layer or by a VELCRO connection 23. The abrasive pad attachment provides abrasive action, for example abrasively removing foot calluses, for skin exfoliation, etc.

Figure 10:
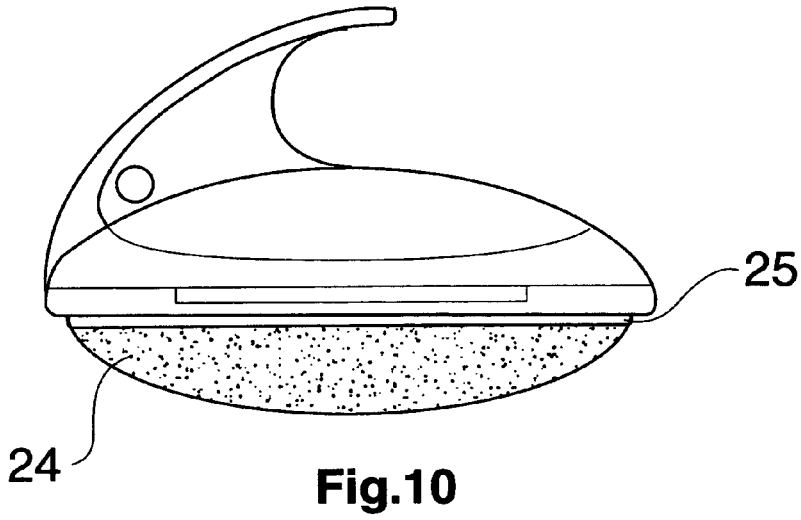

FIG. 10 shows the lower part of the body rubbing device in which the action means is formed as a pumice stone attachment, including a pumice stone 24 and an adhesive layer 25 which connects the same to the lower wall 16. The pumice stone can be glued directly into the upper portion 9. The pumice stone attachment is used for example for removing foot growth, such as calluses, etc.

Figure 11:
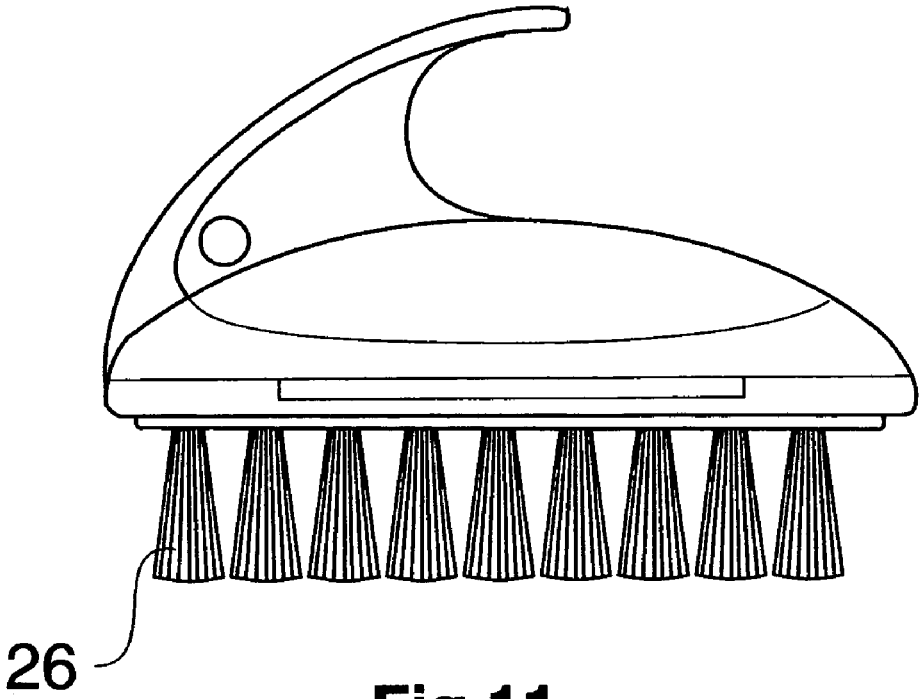

FIG. 11 shows the lower portion of the body rubbing device which is formed as a brush attachment including a plurality of bundles 26 of bristles, which are connected to the lower wall 16, for example by inserting the bundles into small holes provided in the lower wall 16. The brush attachment is used for applying cleaning action to a user's body.

Figure 12:
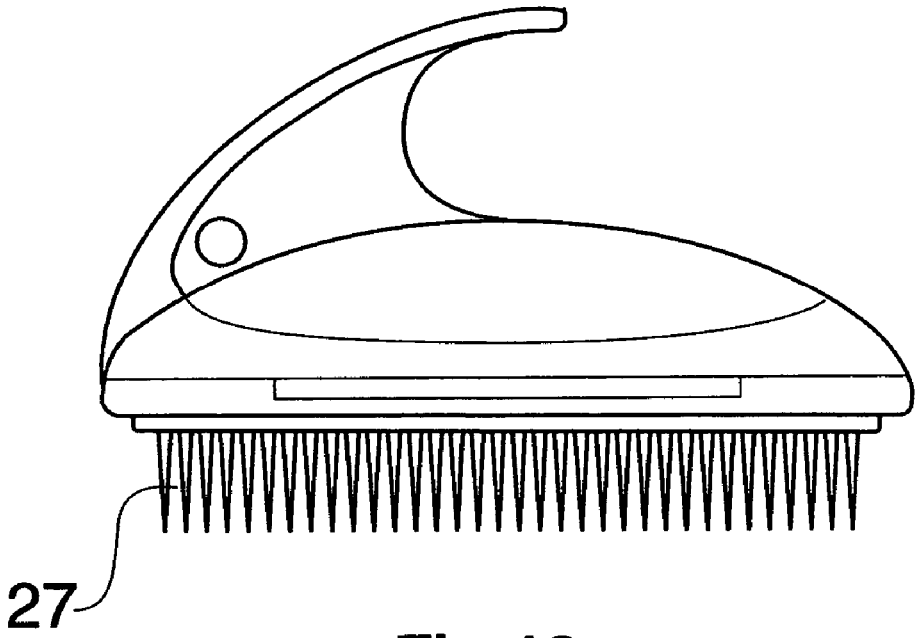
Figure 13:
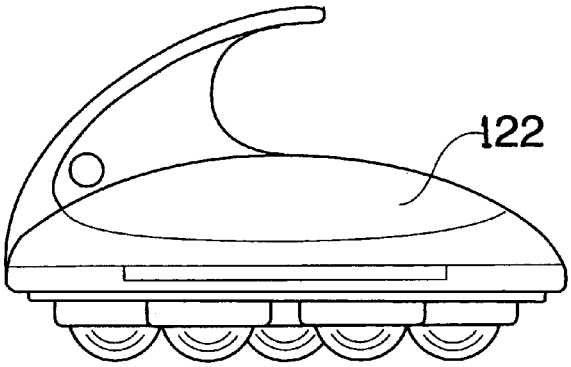
Figure 16:
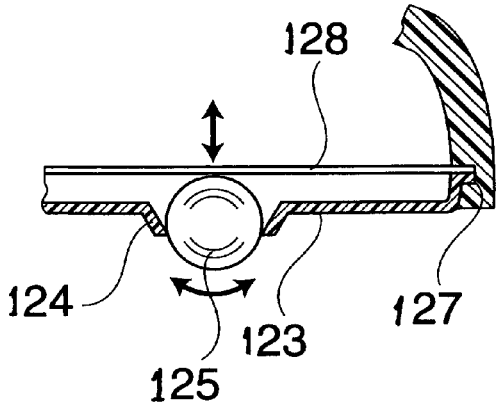
FIG. 16 is a partial cross-section of this device.
Figure 14:
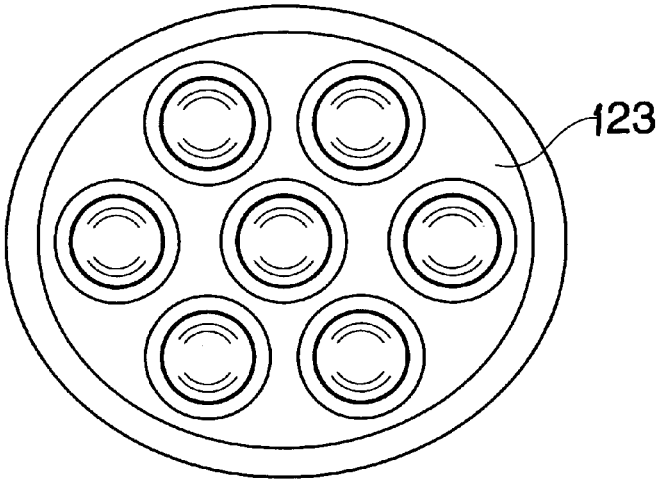
Figure 15:
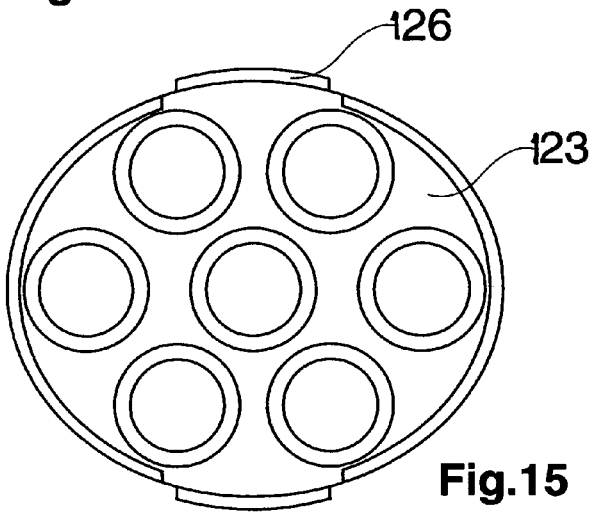

FIG. 12 shows the lower part of the brush which is formed as a finger nail body rubbing device attachment including a plurality of thin plastic projection 27 connected in one piece with the lower wall 16 The attachment is utilized as a finger nail brush.

Figure 17:
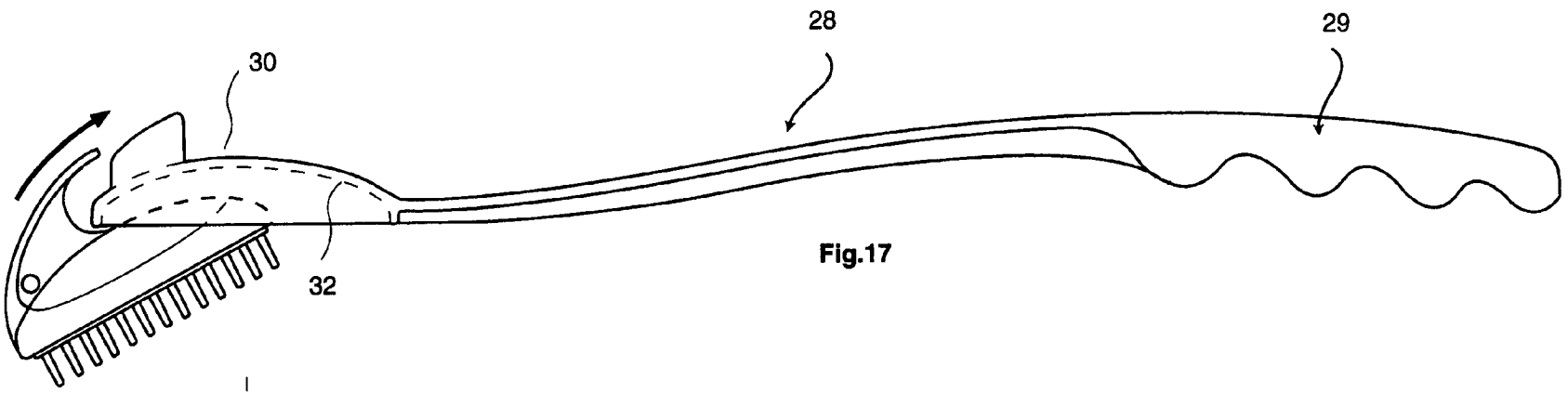
FIG. 17 is a view showing a section of a lock nut of the inventive device.
Figure 18:
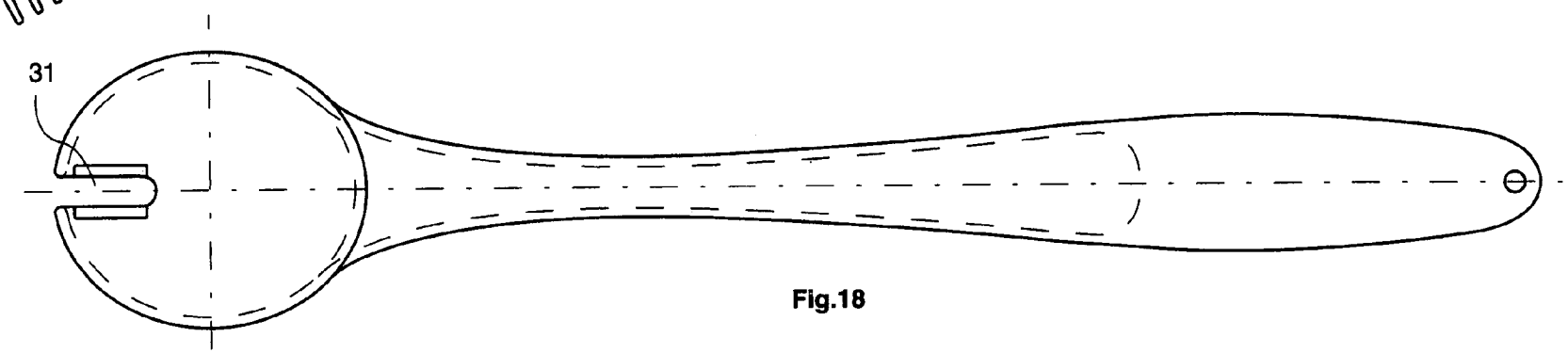
FIG. 18 is a view showing a section of a fixator of the inventive device.

FIGS. 17 and 18 show a side view and a plan view of a removable extension handle 28. The removable extension handle 28 has a distal end 29 designed to be held by a user, and a proximal end 30 connectable with the handle 4. For this purpose the proximal end 30 of the handle 28 can be provided with a slot 31 into which the lower narrow part 5 of the handle 4 can be insertable, for example with elastic action, so that the handle 4 is held in the proximal end of the extension handle 28. The proximal end 30 of the extension handle 28 can have an inner concave surface which substantially corresponds to the upper convex surface 2 of the housing 1, so that in the assembled condition the above mentioned surfaces are in contact with one another.

When the extension handle 28 is attached to the housing 1 of the body rubbing device, the body rubbing device can be used for applying an action in situations which require an extra reach, for example for action on a user's back, user's feet, etc.

FIGS. 13, 14, 15 and 16 are views showing a further modification of the body rubbing device. The body rubbing device shown in these figures has an upper portion 122 and a lower portion 123. The lower portion 123 has a plurality of downwardly extending annular projections 124, which can have for example a conical shape. A plurality of elements, for example balls 125 are held by the projections 124 rotatably in the lower portion 123. The device further has an intermediate wall 128 which can be also clamped in the groove 127 of the upper part 122. In particular the intermediate wall 128 has lateral extensions 126 which are retained in the groove 127.

The intermediate wall 128 is substantially spring-elastic. When the device is applied to a part of the body with its balls 125 and is rolled over the part of a body with a force applied from above downwardly, the balls 125 not only rotate but also slightly move upwardly because of the spring-elastic properties of the intermediate portion 128, so that the balls 125 during the operation of the device move elastically upwardly and downwardly to provide a special massaging action.

It will be understood that each of the elements described above, or two or more together, may also find a useful application in other types of constructions differing from the types described above.

While the invention has been illustrated and described as embodied in shampoo brush, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A body rubbing device, comprising a housing having a lower side adapted to face a body part to be acted upon and an upper side, said housing having an upper surface which is upwardly convex and is elongated in a longitudinal direction to define a substantially oval-shape, said upper convex surface being formed so that a palm of a user's hand can rest on said upper convex surface; a handle placeable between fingers of the user's palm and extending substantially over a part of said housing, said housing also having a lower surface at said lower side; acting means provided on said lower surface of said housing for acting on a body part of a user; and a plurality of color insert plates individually and removably placeable in an interior of said housing, at least a part of said housing being transparent so that a corresponding one of said color insert plates is visible through the housing.

2. A body rubbing device as defined in claim 1, wherein said plurality of color insert plates include insert plates having different colors to identify different uses of the device when a corresponding one of said color insert plates is arranged in said interior of said housing.

3. A body rubbing device as defined in claim 1, wherein said color insert plates are provided with a text.

4. A body rubbing device as defined in claim 1, wherein said housing as a whole is composed of a clear plastic.

5. A body rubbing device as defined in claim 1; and further comprising an opening through which a rope for suspending the brush is extendable.

6. A body rubbing device as defined in claim 5, wherein said opening is provided in said handle in a region located close to said upper concave surface.

7. A body rubbing device as defined in claim 1, wherein said action means include a plurality of elastic spikes extending from said lower surface.

8. A body rubbing device as defined in claim 7, wherein said some of said spikes are provided with tooth-like projections.

9. A body rubbing device as defined in claim 7, wherein said spikes include a first group of spikes provided in a peripheral edge region of said lower surface and second group of spikes provided in a center of said lower surface, said spikes of said first group being thinner than said spikes of said second group.

10. A body rubbing device as defined in claim 1, wherein said action means are formed by a plurality of substantially rigid elements on said lower part of said housing for massaging a body part of the user.

11. A body rubbing device as defined in claim 1, wherein said action means are formed as an abrasive element on said lower part of said housing.

12. A body rubbing device as defined in claim 1, wherein said action means are formed as a brush element on said lower part of said housing.

13. A body rubbing device as defined in claim 1, wherein said action means is formed as a finger nail brush element on said lower part of said housing.

14. A body rubbing device as defined in claim 1, wherein said action means is formed as a pumice stone element on one of said parts of said housing.

15. A body rubbing device as defined in claim 1, wherein said action means are formed as substantially spherical elements arranged rotatably in a lower part of said housing.

16. A body rubbing device as defined in claim 15, wherein said substantially spherical elements are arranged in said lower part of said housing movably in a substantially vertical direction.

17. A body rubbing device as defined in claim 16; and further comprising an intermediate substantially spring-elastic wall against which said substantially spherical elements abut from below so that during an operation of the device said substantially spherical elements are spring-elastically movable up and down.

18. A body rubbing device as defined in claim 1, wherein said housing has a lower wall provided with said action means, said lower wall being formed so that during applying an action a body part of a user said lower wall together with said action means slightly deflects into an interior of said housing.

19. A body rubbing device as defined in claim 18, wherein said housing has a hollow interior, said lower wall being formed so that it deflects inwardly into said hollow interior of said housing.

20. A body rubbing device as defined in claim 1, wherein said handle has a lower narrow part formed to be located between two fingers of a user and a higher broader part formed to be located above the two fingers of a user.

21. A body rubbing device, comprising a housing having a lower side adapted to face a body part to be acted upon and an upper side, said housing having an upper surface which is upwardly convex and is elongated in a longitudinal direction to define a substantially oval-shape, said upper convex surface being formed so that a palm of a user's hand can rest on said upper convex surface; a handle placeable between fingers of the user's palm and extending substantially over a part of said housing, said housing also having a lower surface at said lower side; and acting means provided on said lower surface of said housing for acting on a body part of a user; and a removable extension handle connectable with said first mentioned handle, wherein said removable extension handle has a distal end arranged to be grasped by a user and a proximal end arranged to be connected with said first mentioned handle; and further comprising connecting means for connecting said proximal end of said removable extension handle to said first-mentioned handle, wherein said proximal end of said removable extension handle has an inner concave surface which substantially corresponds to said upper convex surface of said housing so that in assembled condition said inner concave surface and said upper convex surface are in contact with one another.

22. A body rubbing device as defined in claim 21, wherein said handle extends in the longitudinal direction.

23. A body rubbing device as defined in claim 21, wherein said housing is composed of an upper part provided with said upwardly concave surface and said handle, and a lower part provided with said action means, said lower part being removably attachable to said upper part; said lower part being formed as a lower horizontal wall; an adhesive layer connecting said actions means with said lower wall and for removably attaching said lower part to said upper part.

24. A body rubbing device as defined in claim 23, wherein said means for attaching said lower part of said upper part include at least one projection provided in one of said parts, and at least one groove provided in the other of said parts in which said at least one projection is engageable.

25. A body rubbing device as defined in claim 24, wherein said groove is formed as an annular groove, and further comprising at least one another such projection located on an opposite side of said lower part also and engageable in said annular groove.

26. A body rubbing device as defined in claim 21, wherein said connecting means include projections provided on said proximal end of said removable extension handle and forming a slot therebetween, in which slot at least a part of said first mentioned handle is engageable.

* * * * *